US010093105B2

(12) United States Patent
Shimamura et al.

(10) Patent No.: US 10,093,105 B2
(45) Date of Patent: Oct. 9, 2018

(54) LIQUID STORAGE CONTAINER AND LIQUID EJECTION APPARATUS

(71) Applicant: CANON KABUSHIKI KAISHA, Tokyo (JP)

(72) Inventors: Ryo Shimamura, Yokohama (JP); Akira Shiba, Machida (JP); Kazuya Yoshii, Yokohama (JP); Norihiro Ikebe, Kawasaki (JP); Takeho Miyashita, Yokohama (JP); Tomoki Yamamuro, Kawasaki (JP); Atsushi Arai, Yokohama (JP); Masatoshi Ohira, Fujisawa (JP); Tatsuaki Orihara, Tokyo (JP); Hirofumi Okuhara, Tokyo (JP); Kazumasa Matsushita, Kawasaki (JP); Misato Furuya, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/489,445

(22) Filed: Apr. 17, 2017

(65) Prior Publication Data

US 2017/0305166 A1 Oct. 26, 2017

(30) Foreign Application Priority Data

Apr. 22, 2016 (JP) ..... 2016-086461
Apr. 22, 2016 (JP) ..... 2016-086464

(51) Int. Cl.
*B41J 2/175* (2006.01)
*B41J 29/13* (2006.01)

(52) U.S. Cl.
CPC ..... *B41J 2/17553* (2013.01); *B41J 2/1752* (2013.01); *B41J 2/17509* (2013.01); *B41J 29/13* (2013.01)

(58) Field of Classification Search
CPC ... B41J 2/17523; B41J 2/1754; B41J 2/17553
See application file for complete search history.

(56) References Cited

U.S. PATENT DOCUMENTS 5,162,817 A 11/1992 Tajika et al. ..... 347/7
5,179,389 A 1/1993 Arai et al. ..... 347/7
(Continued)

FOREIGN PATENT DOCUMENTS

JP 2012-020497 A 2/2012

OTHER PUBLICATIONS

U.S. Appl. No. 15/603,131, filed May 23, 2017, Inventors: Atsushi Arai; Tomoki Yamamuro; Tatsuaki Orihara; Takeho Miyashita; Kazuya Yoshii; Norihiro Ikebe; Akira Shiba; Ryo Shimamura; Masatoshi Ohira; Hirofumi Okuhara; Kazumasa Matsushita; Misato Furuya.

(Continued)

*Primary Examiner* — Anh T. N. Vo
(74) *Attorney, Agent, or Firm* — Fitzpatrick, Cella, Harper & Scinto

(57) ABSTRACT

To provide a liquid storage container equipped with a plug member that can prevent leakage of a liquid from the liquid storage container and can be opened without causing scatter of the liquid, and a liquid ejection apparatus equipped with the liquid storage container. For the purpose, at least one of a connection part of the convex part with the cover part and an apical part of the convex part most apart from the connection part is provided offset from the centroid of the cover part, seen from a direction orthogonal to an opening surface of a supply port in a state that the plug member is mounted on a supply port of the liquid storage container.

29 Claims, 10 Drawing Sheets

(56) References Cited

U.S. PATENT DOCUMENTS

| | | | | |
|---|---|---|---|---|
| 5,355,158 | A | 10/1994 | Inada et al. | 347/22 |
| 5,381,169 | A | 1/1995 | Arai et al. | 347/33 |
| 5,398,054 | A | 3/1995 | Fukazawa et al. | 347/33 |
| 5,534,898 | A | 7/1996 | Kashino et al. | 347/33 |
| 5,606,354 | A | 2/1997 | Bekki et al. | 347/33 |
| 5,613,616 | A * | 3/1997 | Monus | B65D 17/165 215/354 |
| 5,646,655 | A | 7/1997 | Iwasaki et al. | 347/17 |
| 5,748,207 | A | 5/1998 | Inui et al. | 347/43 |
| 5,777,649 | A | 7/1998 | Otsuka et al. | 347/94 |
| 5,831,652 | A | 11/1998 | Hinami et al. | 347/86 |
| 5,980,021 | A | 11/1999 | Nagoshi et al. | 347/49 |
| 5,984,449 | A | 11/1999 | Tajika et al. | 347/15 |
| 5,988,783 | A | 11/1999 | Tajika et al. | 347/7 |
| 6,015,203 | A | 1/2000 | Arai et al. | 347/33 |
| 6,050,669 | A | 4/2000 | Yano et al. | 347/23 |
| 6,241,350 | B1 | 6/2001 | Otsuka et al. | 347/94 |
| 6,314,866 | B1 * | 11/2001 | Melton | A47G 19/16 426/433 |
| 6,345,888 | B1 | 2/2002 | Matsumoto et al. | 347/86 |
| 6,402,308 | B1 | 6/2002 | Hattori et al. | 347/86 |
| 6,476,926 | B1 | 11/2002 | Yano et al. | 358/1.14 |
| 6,505,923 | B1 | 1/2003 | Yamamoto et al. | 347/85 |
| 6,719,395 | B2 | 4/2004 | Iwasaki et al. | 347/19 |
| 7,175,042 | B2 * | 2/2007 | Durdon | B65D 47/0842 220/254.3 |
| 7,175,264 | B2 * | 2/2007 | Qingguo | B41J 2/17556 347/85 |
| 8,454,139 | B2 * | 6/2013 | Ishizawa | B41J 2/175 347/84 |
| 8,529,035 | B2 | 9/2013 | Tsukamoto et al. | 347/86 |
| 8,529,037 | B2 | 9/2013 | Miyashita et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,016,842 | B2 | 4/2015 | Miyashita et al. | 347/86 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 9,597,884 | B2 | 3/2017 | Nanjo et al. | B41J 2/17546 |
| 9,707,768 | B2 * | 7/2017 | Nishimaki | B65D 41/005 |
| 2011/0209335 | A1 | 9/2011 | Yamamoto et al. | 29/505 |
| 2012/0013687 | A1 | 1/2012 | Ishizawa et al. | 347/85 |
| 2015/0343793 | A1 | 12/2015 | Takada et al. | B41J 2/17556 |
| 2015/0352851 | A1 | 12/2015 | Shiba et al. | B41J 2/17513 |
| 2016/0200114 | A1 | 7/2016 | Nanjo et al. | B41J 2/17546 |
| 2016/0347078 | A1 | 12/2016 | Kato et al. | B41J 2/175 |
| 2017/0087863 | A1 | 3/2017 | Miyashita et al. | B41J 2/17553 |
| 2017/0096010 | A1 | 4/2017 | Nanjo et al. | B41J 2/17546 |
| 2017/0120606 | A1 | 5/2017 | Koshikawa et al. | B41J 2/1754 |
| 2017/0120613 | A1 | 5/2017 | Ikebe et al. | B41J 2/17553 |

OTHER PUBLICATIONS

U.S. Appl. No. 15/625,960, filed Jun. 16, 2017, Inventors: Takeho Miyashita; Ryo Shimamura; Akira Shiba; Kazuya Yoshii; Norihiro Ikebe; Tomoki Yamamuro; Atsushi Arai; Masatoshi Ohira; Tatsuaki Orihara; Hirofumi Okuhara; Kazumasa Matsushita; Misato Furuya.

U.S. Appl. No. 15/603,131, filed May 23, 2017.

U.S. Appl. No. 15/625,960, filed Jun. 16, 2017.

U.S. Appl. No. 15/590,762, filed May 9, 2017, Inventors: Kyoshiro Okude; Maseteru Komori; Masato Koshimizu; Tsuyoshi Saeki; Yukimichi Kimura; Masahiro Kawanishi; Masaaki Matsuura; Katsuyuki Yokoi; Akira Shiba; Ryo Shimamura; Kazuya Yoshii; Norihiro Ikebe; Takeho Miyashita; Tomoki Yamamuro; Atsushi Arai; Masatoshi Ohira; Tatsuaki Orihara; Hirofumi Okuhara; Kazumasa Matsushita; Misato Furuya.

U.S. Appl. No. 15/332,604, filed Oct. 24, 2016, Inventors: Kazuya Yoshii; Hiroki Hayashi; Tsubasa Takaoka; Ryo Shimamura; Akira Shiba.

U.S. Appl. No. 15/338,031, filed Oct. 28, 2016, Inventors: Akira Shiba; Tsubasa Takaoka; Hiroki Hayashi; Kazuya Yoshii; Ryo Shimamura.

U.S. Appl. No. 15/353,238, filed Nov. 16, 2016, Inventors: Hiroki Hayashi; Tsubasa Takaoka; Kazuya Yoshii; Ryo Shimamura; Akira Shiba.

U.S. Appl. No. 15/489,437, filed Apr. 17, 2017, Inventors: Norihiro Ikebe; Ryo Shimamura; Akira Shiba; Kazuya Yoshii; Takeho Miyashita; Tomoki Yamamuro; Atsushi Arai; Masatoshi Ohira; Tatsuaki Orihara; Hirofumi Okuhara; Kazumasa Matsushita; Misato Furuya.

U.S. Appl. No. 15/479,816, filed Apr. 5, 2017, Inventors: Tatsuaki Orihara; Ryo Shimamura; Akira Shiba; Kazuya Yoshii; Norihiro Ikebe; Takeho Miyashita; Tomoki Yamamuro; Atsushi Arai; Masatoshi Ohira; Hirofumi Okuhara; Kazumasa Matsushita; Misato Furuya.

U.S. Appl. No. 15/590,762, filed May 9, 2017.

U.S. Appl. No. 15/332,604, filed Oct. 24, 2016.

U.S. Appl. No. 15/338,031, filed Oct. 28, 2016.

U.S. Appl. No. 15/353,238, filed Nov. 16, 2016.

U.S. Appl. No. 15/489,437, filed Apr. 17, 2017.

U.S. Appl. No. 15/479,816, filed Apr. 5, 2017.

* cited by examiner

LIQUID STORAGE CONTAINER AND LIQUID EJECTION APPARATUS

BACKGROUND OF THE INVENTION

Field of the Invention

The present invention relates to a liquid storage container capable of storing a liquid and a liquid ejection apparatus equipped with the liquid storage container.

Description of the Related Art

As liquid ejection apparatus used now, those equipped with a liquid ejection head for ejecting a liquid, and a liquid storage container for storing a liquid to be supplied to the liquid ejection head are commonly used. The liquid is supplied from the liquid storage container to the liquid ejection head via a tube or a liquid flow path.

On the other hand, in Japanese Patent Laid-Open No. 2012-20497, there is disclosed a liquid ejection apparatus which is equipped with a large-capacity liquid storage container as compared with the liquid ejection apparatus of a type of supplying a liquid to the liquid ejection head from the liquid storage container as described above, and injects a liquid from an injection port equipped in the liquid storage container. The liquid storage container equipped in the liquid ejection apparatus disclosed in Japanese Patent Laid-Open No. 2012-20497 is equipped with an injection port for injecting a liquid, and a plug member preventing leakage of a liquid from the injection port. The plug member has a detachable structure relative to the injection port, and, when a liquid is injected, the plug member is removed from the injection port, and, in other instances, is fitted to the injection port in order to prevent leakage of the liquid to the outside.

The plug member is press-fitted to the injection port so as to be mounted on the liquid storage container, thereby preventing leakage of a liquid from the liquid storage container. When removing the plug member from the injection port of the liquid storage container, it is removed by pinching and pulling a pinch part equipped in the plug member, and, since the plug member is press-fitted to the injection port, it is to be removed against friction force acting on the whole circumference in the part to which the plug member is press-fitted. Accordingly, a strong force is necessary when removing the plug member. In addition, there is such a problem that, since the friction force disappears instantaneously at the press-fitted part at an instant when the plug member disengages, the plug member disengages swiftly and the liquid in the liquid storage container scatters to the outside.

SUMMARY OF THE INVENTION

Accordingly, the present invention provides a liquid storage container equipped with a plug member that can prevent leakage of a liquid from the liquid storage container and can be opened without causing scatter of the liquid, and a liquid ejection apparatus equipped with the liquid storage container.

Therefore, the liquid storage container of the present invention includes a storage chamber for storing a liquid, a supply port capable of supplying a liquid to the storage chamber, and a plug member mounted detachably on the supply port, wherein the plug member has a main body part lying outside of the storage chamber and the supply port in a state mounted on the supply port, the main body part has a cover part covering an opening surface of the supply port in the mounted state of the plug member, a support part capable of connecting the cover part with another member and a convex part protruding from the cover part; and the convex part is arranged on one side of the cover part and the support part is arranged on the other side of the cover part relative to a straight line intersecting orthogonally with a straight line passing a centroid of the cover part and connecting the centroid and the support part, seen from a direction intersecting orthogonally with the opening surface in the mounted state of the plug member.

According to the present invention, it is possible to realize a liquid storage container equipped with a plug member that can prevent leakage of a liquid from the liquid storage container and can be opened without scatter of the liquid, and a liquid ejection apparatus equipped with the liquid storage container.

Further features of the present invention will become apparent from the following description of exemplary embodiments with reference to the attached drawings.

DESCRIPTION OF THE EMBODIMENTS

First Embodiment

Hereinafter, a first embodiment of the present invention will be described with reference to the drawings.

Figure 1:
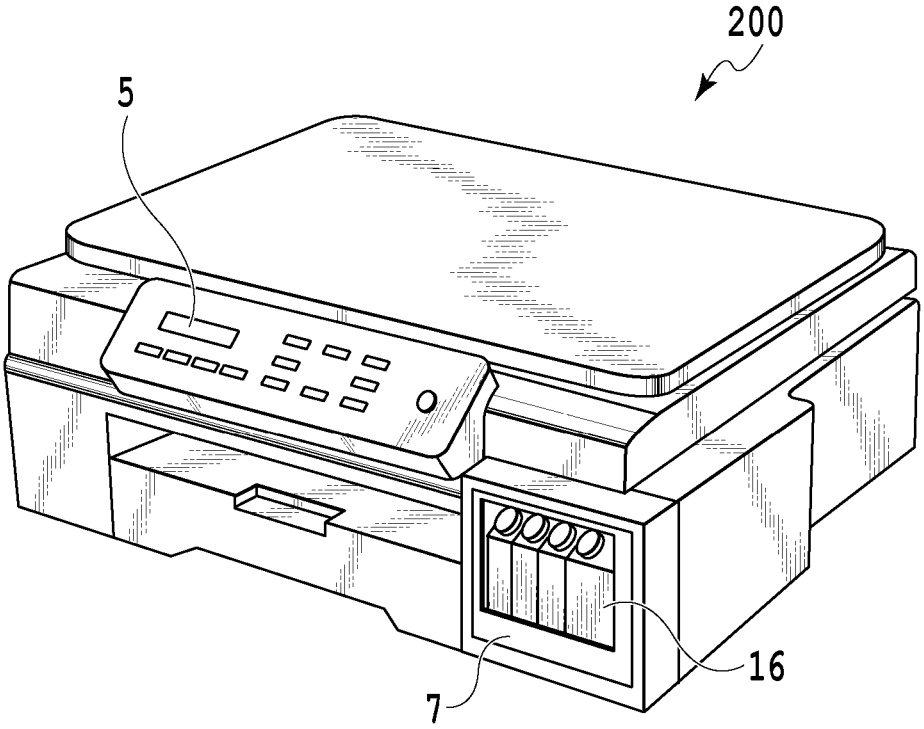
FIG. 1 shows a perspective view showing a mechanical part of a liquid ejection apparatus.
Figure 2:
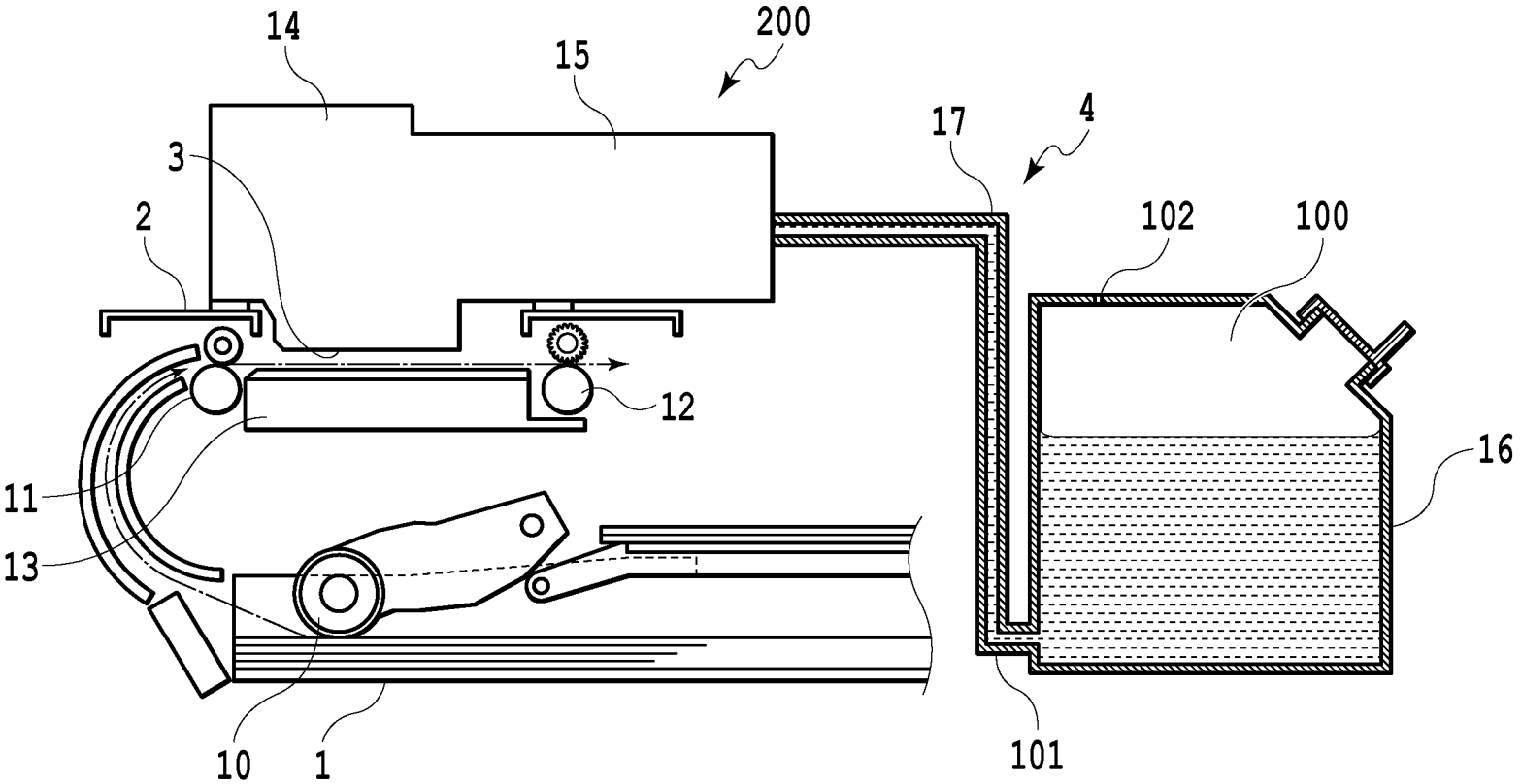
FIG. 2 shows a cross-section of the liquid ejection apparatus.

FIG. 1 shows a perspective view showing a mechanical part of a liquid ejection apparatus 200 to which the present embodiment is applicable, and FIG. 2 shows a cross-section of the liquid ejection apparatus 200. The liquid ejection apparatus 200 is equipped with a feed part 1, a convey part 2, an ejection part 3, a supply part 4 and a display part 5. The feed part 1 separates a print medium one by one from a bundle of print media using a feeding roller 10 to supply the medium to the convey part 2. The convey part 2 is equipped with a platen 13 that is provided on the downstream side in the convey direction of the feed part 1 and holds a print medium, between a convey roller 11 and a discharge roller 12. The convey part 2 conveys a print medium fed from the feeding roller 10 using the convey roller 11, the discharge roller 12 etc.

The ejection part 3 ejects a liquid to a print medium with a liquid ejection head 15 mounted on a carriage 14. A print medium conveyed with the convey part 2 is supported vertically from the lower side with the platen 13. Then, a liquid is ejected from the liquid ejection head 15 lying on the vertically upper side to form an image based on image information. A liquid storage container 16 can store a liquid in the container, and the supply part 4 is configured to be capable of supplying the liquid to the liquid ejection head 15 from a storing chamber 100 (storage chamber) of the liquid storage container 16 via a flow path 101 and a flexible supply tube 17.

In the present embodiment, the liquid is ink, and, in detail, four supply tubes 17, through which ink of respective colors (black, magenta, cyan, yellow) flows, extend from the liquid storage container 16 and are connected with the liquid ejection head 15 in a bundled state. When the liquid supplied to the liquid ejection head 15 is ejected from the ejection port of the liquid ejection head 15, the liquid is supplied to the liquid ejection head 15 from the liquid storage container 16 in the same quantity as that has been ejected. Further, into the liquid storage container 16, the air flows in the same quantity as that of the liquid supplied to the liquid ejection head 15 through an air communicating port 102 provided in a vertically upper part of the liquid storage container 16. The display part 5 is used for informing a user of conditions of the apparatus under operation and performing display when the user selects an operation.

Figure 3:
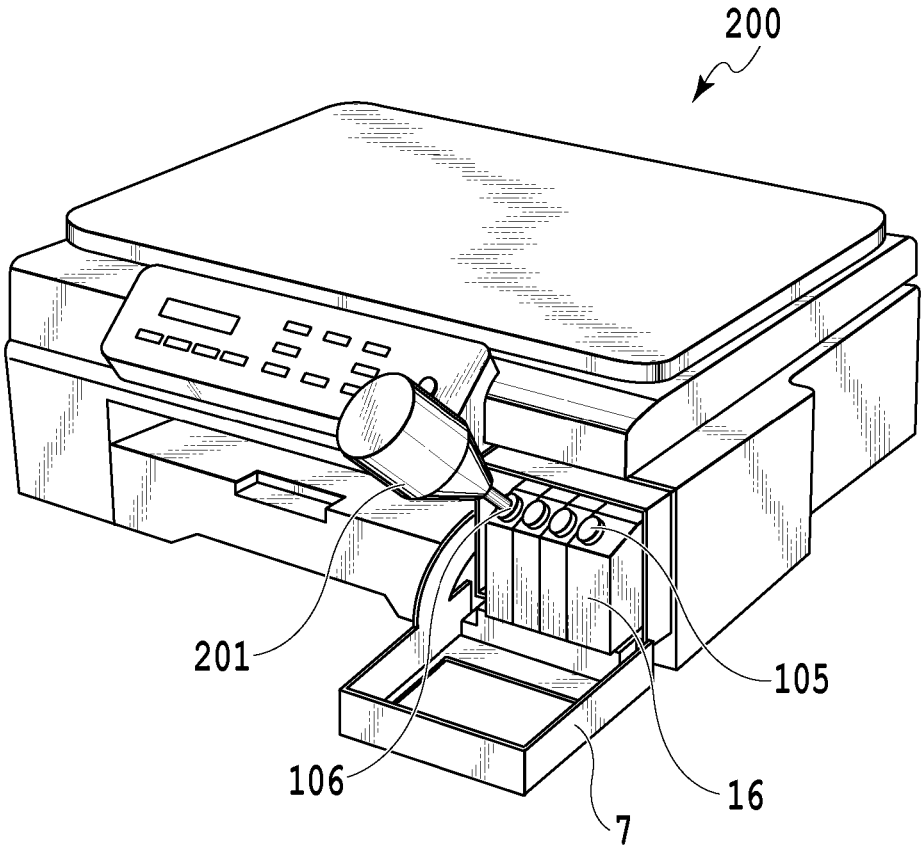
FIG. 3 shows a perspective view showing the liquid ejection apparatus in which a liquid is refilled by a liquid refilling container.

FIG. 3 shows a perspective view showing the liquid ejection apparatus 200 in which a liquid is refilled by a liquid refilling container 201. As shown in the drawing, in the liquid ejection apparatus 200 of the present embodiment, a container cover 7 is opened when a liquid is supplied and the liquid is supplied into the storing chamber 100 from the liquid refilling container 201 via a supply port 106 equipped in the liquid storage container 16. For the supply port 106, a plug member 105 that is detachable relative to the supply port 106 is provided, and, when refill is performed with the liquid refilling container 201, the plug member 105 of the supply port 106 is removed to supply a liquid. Note that the configuration of the liquid storage container 16 is not limited to one built in the main body of the liquid ejection apparatus 200 as in the present embodiment, and such a configuration that the liquid storage container 16 is provided outside the main body of the liquid ejection apparatus 200 is also acceptable when a liquid can be supplied to the liquid ejection head 15 from the liquid storage container 16.

Figure 4:
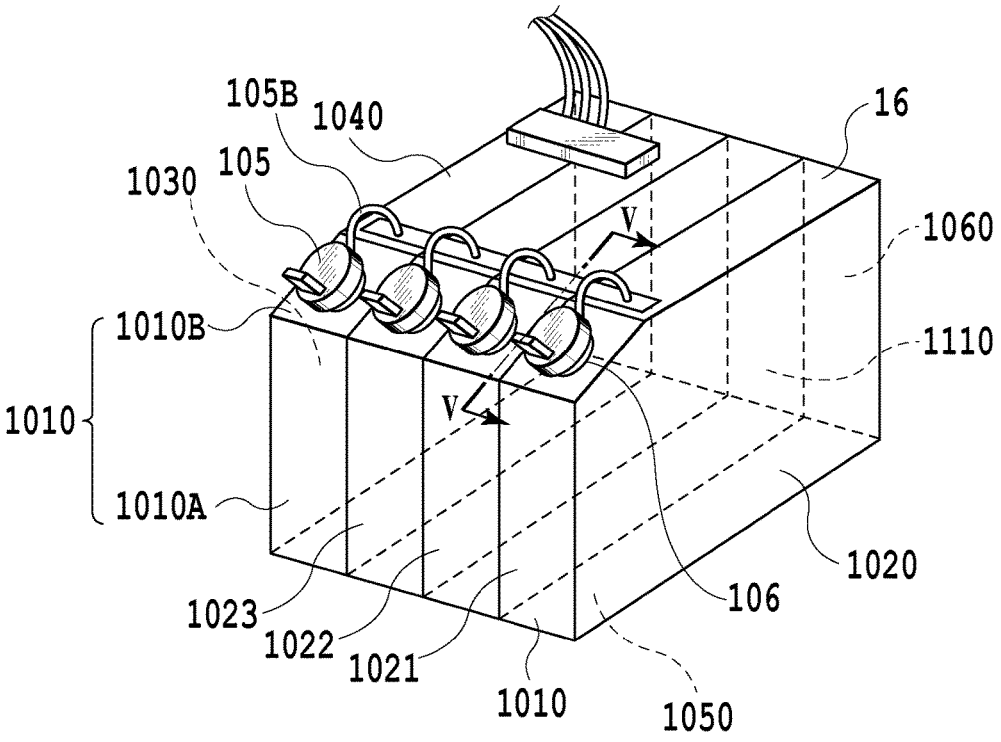
FIG. 4 shows a perspective view showing a liquid storage container of the liquid ejection apparatus.

FIG. 4 shows a perspective view showing the liquid storage container 16 of the liquid ejection apparatus 200 to which the present embodiment is applicable. The liquid storage container 16 in the present embodiment is formed from a synthetic resin such as polypropylene and presents an approximately rectangular parallelepiped external form. The liquid storage container 16 has a front wall 1010, a right wall 1020, a left wall 1030, an upper wall 1040 and a lower wall 1050. The front wall 1010 includes a standing wall 1010A extending approximately in the vertical direction from the lower wall 1050, and an inclined wall 1010B (an example of an outside wall) that is connected to the upper end of the standing wall 1010A and inclined relative to the vertical direction and the longitudinal direction. The inclined wall 1010B inclines toward the rear side relative to the standing wall 1010A, and the supply port 106 is formed in the inclined wall 1010B.

On the other hand, the rear face of the liquid storage container 16 is opened. Further, a film 1060 is welded to the rear end part of the right wall 1020, the left wall 1030, color separation walls 1021, 1022, and 1023, the upper wall 1040 and the lower wall 1050, so as to seal the liquid storage container 16 and form a rear wall which is a rear face. That is, the rear wall of the liquid storage container 16 is formed by the film 1060. In this way, a liquid chamber 1110 is formed.

Figure 5A:
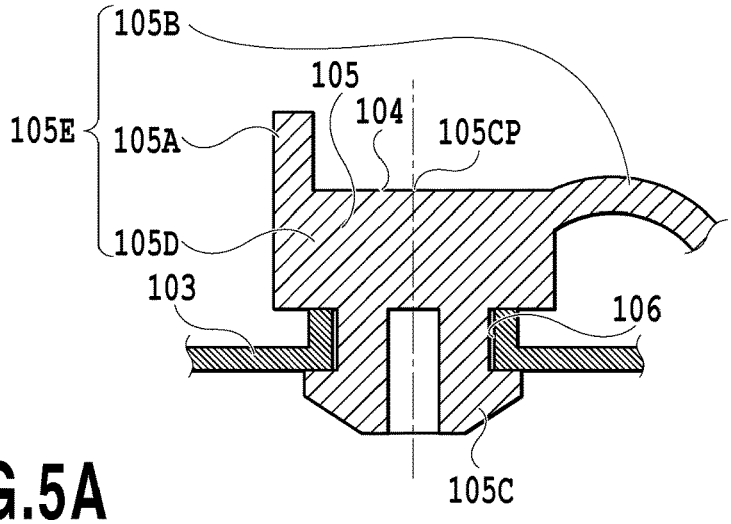
FIG. 5A shows an embodiment of a plug member.
Figure 5B:
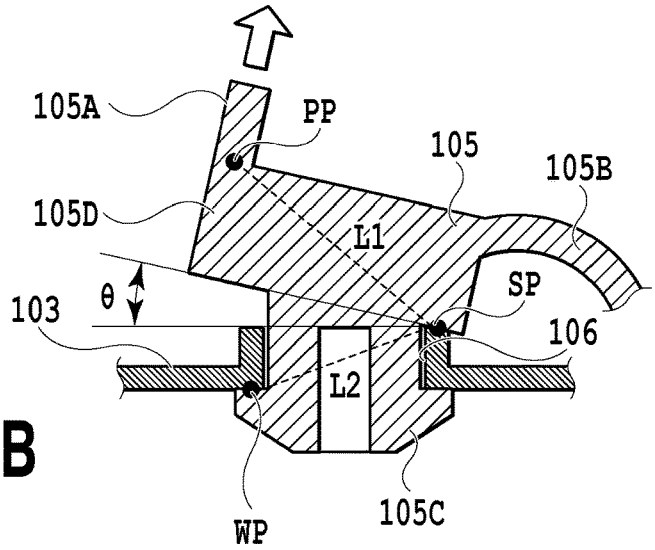
FIG. 5B shows an embodiment of the plug member.

FIGS. 5A and 5B show cross-sections along V-V in FIG. 4, and an embodiment of the plug member 105 in the present invention. FIG. 5A shows a state in which the plug member 105 is mounted on the supply port 106. The plug member 105 is press-fitted to the supply port 106 for obtaining sealing properties of preventing leakage of a liquid, and, therefore, is generally formed from a flexible member such as rubber. The plug member 105 is equipped with a main body part 105E lying on the outside relative to the storing chamber 100 and the supply port 106 in the mounted state, and a plug part 105C inserted in a supply port to plug up the supply port. The plug member 105 is transformed elastically so as to sandwich the supply port 106 from the vertical direction to be mounted on the supply port 106.

The main body part 105E in the present embodiment is equipped with a convex part 105A through which a user may apply power to the plug member 105 when the member is removed from the supply port 106, a support part 105B capable of being connected with the liquid storage container main body, and a cover part 105D covering an opening surface of the supply port 106. The convex part 105A is provided, protruding from an upper surface 104 of the cover part 105D of the plug member 105. Note that the upper surface 104 lies along the opening surface of the supply port 106 in a state that the plug member 105 is mounted on the supply port 106. Further, the base part of the convex part 105A and the support part 105B are arranged, separated on one side and on the other side relative to the center part 105CP of the plug member 105. That is, the convex part 105A and the support part 105B are arranged on one side and on the other side sandwiching a plane including the center axis of the plug member 105 intersecting approximately vertically with the opening surface of the supply port 106, when the plug member 105 is mounted on the supply port 106.

Figure 5C:
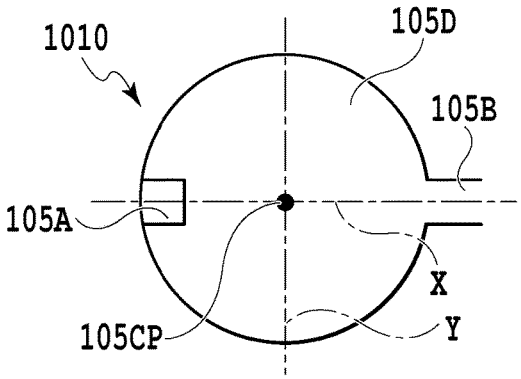
FIG. 5C shows an embodiment of the plug member.

The arrangement of the convex part 105A and the support part 105B will be described more specifically by use of FIG. 5C. FIG. 5C shows a top view of a state that the plug member 105 is mounted on the supply port 106, seen from the direction orthogonal to the opening surface of the supply port 106. In the present embodiment, the shape of the upper surface 104 of the cover part 105D is circular, and the center part 105CP of the plug member 105 is the center of the upper surface 104 of the cover part 105D, as shown in FIG. 5C. Further, in the present embodiment, the shape of the upper surface 104 is circular and the center of the upper surface 104 and the centroid of the upper surface 104 lie at the same position, and, therefore, "the center (part)" and "the centroid (part)" may be used as a synonym in the description. Further, an imaginary straight line Y passing the center part CP shown in FIG. 5C intersects orthogonally with an imaginary straight line X linking the center part 105CP (the centroid part) with the support part 105B. Here, the convex part 105A is arranged on one side of the cover part 105D relative to the imaginary straight line Y, and the support part 105B is arranged on the other side of the cover part 105D, in a state that the plug member 105 is mounted on the supply port 106.

Note that, "protruding" of the convex part 105A in the preset specification refers to a state that the convex part 105A protrudes sufficiently to such a degree that a user can pinch it or add force to it. As the result that the convex part 105A and the support part 105B are provided in such an arrangement, a user is facilitated to pinch the convex part 105A and pull it up toward the support part 105B when removing the plug member 105 from the supply port 106. As the result that the convex part 105A provided on one side of the plug member 105 is pulled up toward the support part 105B in this way, the plug member 105 is deformed gradually from the side on which the convex part 105A is provided so as to disengage from the supply port 106, and the removal with comparatively weak force becomes possible.

Further, as the result of deformation of the plug member 105 from one side, the press-fitted part force is gradually relieved of the force so as to disengage, and, therefore, the plug member 105 does not instantaneously disengage from the supply port 106, whereby it becomes possible to prevent scattering of the liquid stored in the liquid storage container 16 to the outside. Furthermore, the plug member 105 is equipped with the support part 105B capable of supporting the plug member 105, and the cover part 105D of the plug member is connected with the liquid storage container main body by the support part 105B. Therefore, the cover part does not fall off. Note that the other side of the connection of the plug member 105 by the support part 105B is not limited to the liquid storage container main body, and may be any member as long as the plug member 105 does not fall off therefrom.

FIG. 5B shows the plug member 105 having been deformed by force added from a user when the plug member 105 is opened. When a user pulls the convex part 105A in the arrow direction in the drawing, the plug member 105 inclines increasing an angle θ to be deformed, setting a part on one side on which the support part 105B of the supply port 106 is provided as a fulcrum. At this time, the relationship of forces applied to the plug member 105 is based on the principle of leverage, denoting the root of the convex part 105A by a power point PP, a part of the supply port 106 lying on a side on which the support part 105B is provided by a supporting point SP, and a point lying in a lower part of the supply port on the opposite side of the supporting point SP by a working point WP. Here, the distance from the supporting point SP to the power point PP is defined as L1, and the distance from the working point WP to the supporting point SP is defined as L2. By setting the distance L1 longer than the distance L2 (the distance L1>the distance L2), a small force added to the power point PP becomes a large force at the working point WP, and the plug member 105 can be removed from the supply port 106 without requiring a strong force.

Note that, as shown in FIG. 5C, it is preferable that a part of the convex part 105A is arranged on the extension line of the above-described imaginary straight line X in a state that the plug member 105 is mounted on the supply port 106. This is because, the aforementioned arrangement further facilitates a user to pinch the convex part 105A and pull it up toward the support part 105B when removing the plug member 105 from the supply port 106. Further, as shown in FIG. 5C, it is preferable that the convex part 105A is arranged at the end part of the cover part 105D on one side relative to an imaginary straight line Y, and the support part 105B is arranged at the end part of the cover part 105D on the other side.

This is because the aforementioned arrangement realizes a longer distance between the convex part 105A and the support part 105B, making the distance L1 as described in FIG. 5B longer, and therefore facilitates the plug member 105 to be removed easier from the supply port 106. Note that the arrangement of the convex part 105A and the support part 105B is not limited to the arrangement as shown in FIG. 5C. That is, the convex part 105A may be arranged in any position in a region lying on one side of the cover part 105D relative to the imaginary straight line Y, and, in addition, the support part 105B may be arranged in any position in a region lying on the other side of the cover part 105D relative to the imaginary straight line Y.

Note that the shape of the convex part 105A is not limited to the foregoing, and, for example, a spherical or rectangular projecting shape may be provided at the front end of the convex part. By providing the projecting shape at the front end, fingers of a user can catch the convex part easily when the user pinches it to make it possible to add easily force to the convex part.

Further, the support part 105B may be formed integrally with the plug member 105 or may be formed as a separate body.

Further, the shape of upper face of the cover part 105D is not limited to a circular one as described above, and, for example, may be a symmetric shape such as a rectangle, or an asymmetric shape. In these cases, too, the convex part 105A may be arranged on one side and the support part 105B may be arranged on the other side, relative to the imaginary straight line Y passing the centroid of the plug member 105, that is, the center of mass when mass is distributed uniformly on the upper surface 104 of the cover part 105D.

Modified Examples

Hereinafter, modified examples of the present embodiment will be described.

Figure 6A:
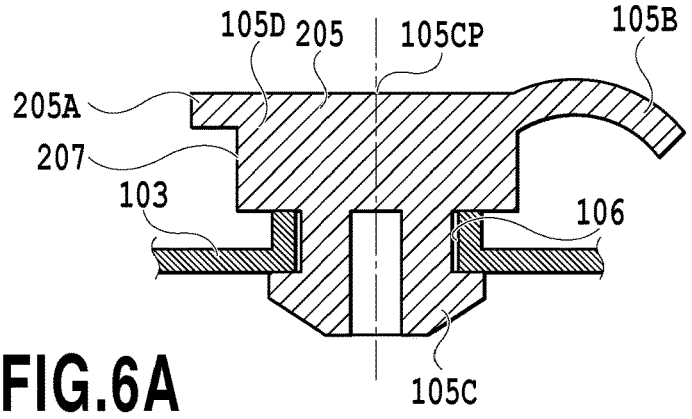
FIG. 6A shows a plug member in a modified example.
Figure 6B:
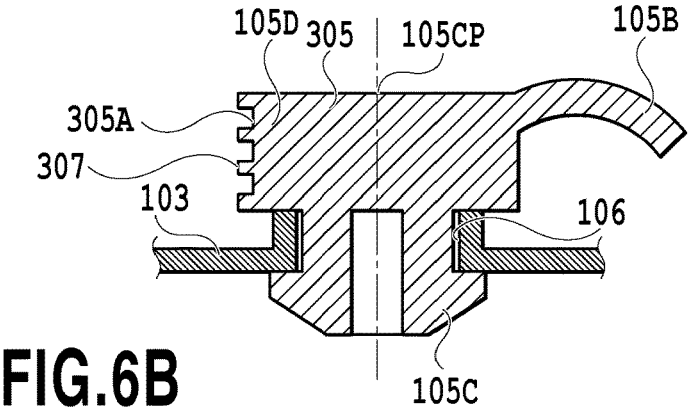
FIG. 6B shows a plug member in the modified example.
Figure 6C:
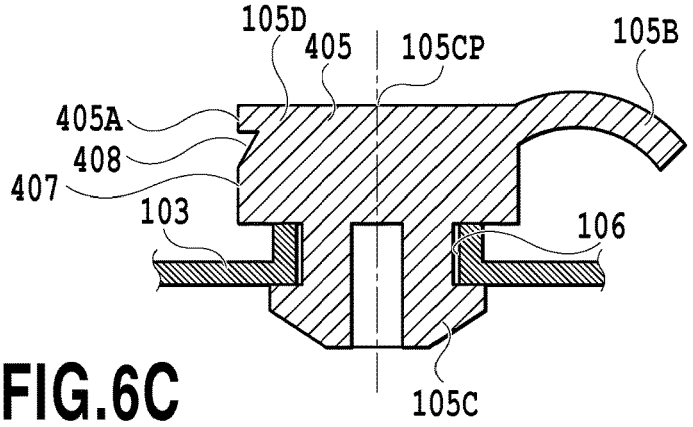
FIG. 6C shows a plug member in the modified example.

FIGS. 6A to 6C show plug members in modified examples of the present embodiment. A plug member 205 in FIG. 6A is equipped with a convex part 205A, and the convex part 205A is provided, protruding from a side face 207 of a cover part 105C of the plug member 105. Further, the base part and the support part 105B of the convex part 205A are arranged, separated on one side and on the other side relative to the center part 105CP of the plug member 105. A plug member 305 in FIG. 6B is equipped with a convex part 305A, and the convex part 305A is formed having a plurality of groove parts provided for a side face 307 of a cover part 105C of the plug member 105. The convex part 305A functions such that, when a user puts a finger on the side face 307 to remove the plug member 305, the frictional force between the side face 307 and the finger is strengthened. Note that the convex part 305A and the support part 105B are arranged, separated on one side and on the other side relative to the center part 105CP of the plug member 105.

Further, a plug member 405 in FIG. 6C is equipped with a convex part 405A, and the convex part 405A is formed having a notch 408 provided for a side face 407 of a cover part 105C of the plug member 105. The convex part 405A functions such that, when a user puts a finger on the side face 407 to remove the plug member 405, the frictional force between the side face 407 and the finger is strengthened. Note that the convex part 405A and the support part 105B are arranged, separated on one side and on the other side relative to the center part 105CP of the plug member 105. Note that the side face of the cover part 105C in each of modified examples intersects approximately orthogonally with the opening surface of the supply port 106 in a state that the plug member 105 is mounted on the supply port 106.

Note that, in the present embodiment, although a configuration that the plug member is equipped with a main body part and a plug part is described, configurations are not limited thereto, and a so-called cap type member is also acceptable, which includes only a main body part without a plug part.

In this way, seen from the direction intersecting orthogonally with the opening surface of the supply port being in a state that the plug member is mounted on the supply port of the liquid storage container, at least one of the connection part of the convex part with the cover part and the apical part of the convex part lying most apart from the connection part is provided offset from the centroid of the cover part. Hereby, there is realized a liquid storage container equipped with a plug member capable of preventing leakage of a liquid from the liquid storage container and being opened without causing scatter of the liquid, and a liquid ejection apparatus equipped with the liquid storage container.

Second Embodiment

Hereinafter, a second embodiment of the present invention will be described with reference to the drawings. Note that the basic configuration of the present embodiment is the same as that of the first embodiment, and, therefore, only characteristic configurations will be described.

Figure 7A:
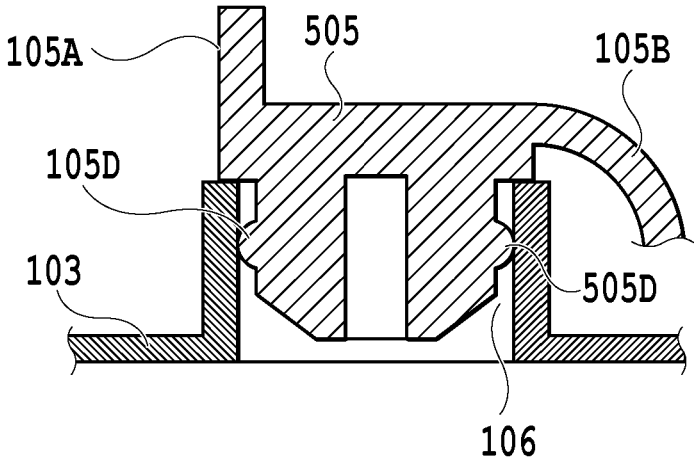
FIG. 7A shows an embodiment of the plug member.
Figure 7B:
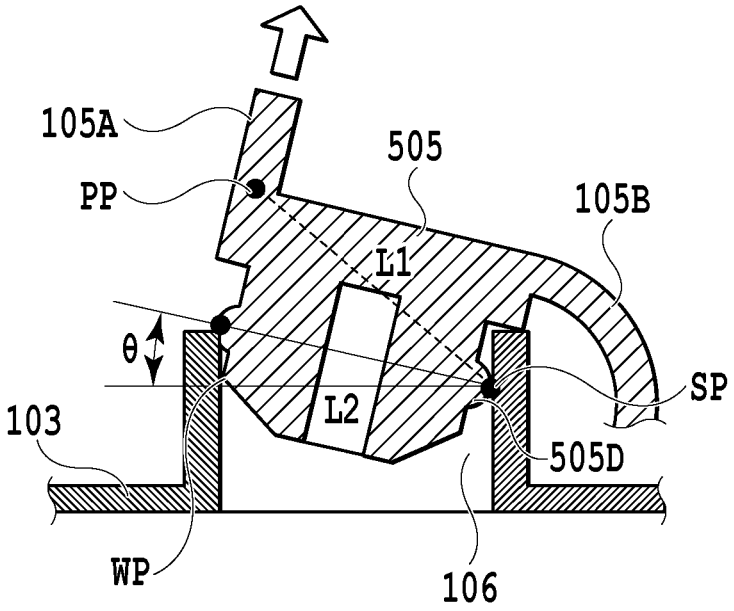
FIG. 7B shows an embodiment of the plug member.

FIGS. 7A and 7B show an embodiment of a plug member 505 in the present embodiment. As shown in FIG. 7A, the plug member 505 has a protruding part 505D on a periphery of a part to be press-fitted in the plug member 505, so as to abut on the inner wall of the supply port 106 to be deformed, and, when mounting the plug member 505 on the supply port 106, the protruding part 505D is deformed to seal the supply port 106. Note that the protruding part 505D desirably has, for example, a cross-section shape of R or a triangle.

FIG. 7B shows a situation that force is applied to the plug member 505 by a user when opening the plug member 505. When the user pulls the convex part 505A in the arrow direction in the drawing, the plug member 505 inclines increasing an angle θ to be deformed, setting the protruding part 505D lying on the side on which the support part 105B is provided as a fulcrum. At this time, the relationship of forces applied to the plug member 505 is based on the principle of leverage, denoting the base of the convex part by the power point PP, the abutting part of the protruding part 505D lying on the side equipped with the support part 105B and the supply port side face by a supporting point SP, and a point lying in a lower part of supply port on the opposite side of the supporting point SP by the working point WP.

According to the plug member 505 of the present embodiment, the supply port 106 is sealed due to an elastic deformation of the protruding part 505D by press-fit of the inner wall of the supply port 106 and the protruding part 505D. Accordingly, the plug member can be removed easily without causing scatter of a liquid based on the above-described principle of leverage.

As described above, there is proposed a configuration in which the protruding part 505D is provided on a periphery of a part to be press-fitted in the plug member 505, and that the protruding part 505D is deformed to seal the supply port 106. Hereby, there is realized a liquid storage container equipped with a plug member capable of preventing leakage of a liquid from the liquid storage container and being opened without causing scatter of the liquid, and a liquid ejection apparatus equipped with the liquid storage container.

Third Embodiment

Figure 8:
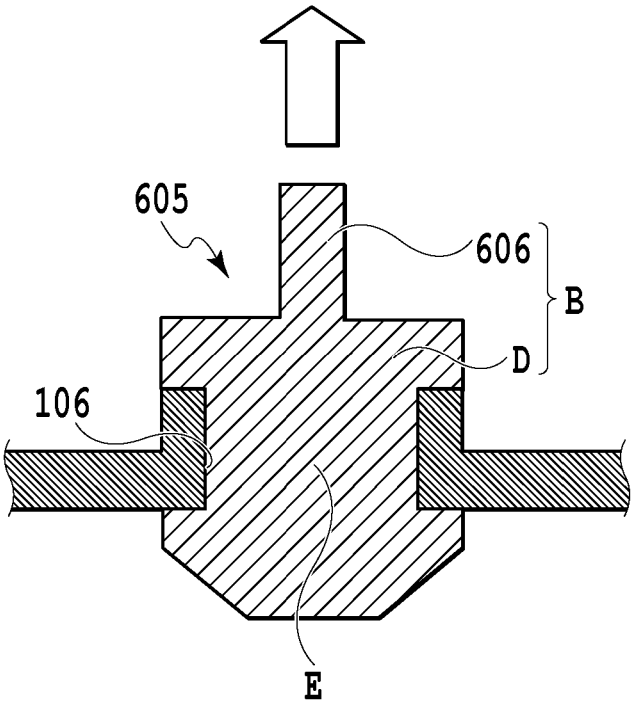
FIG. 8 shows a conventional plug member.
Figure 9A:
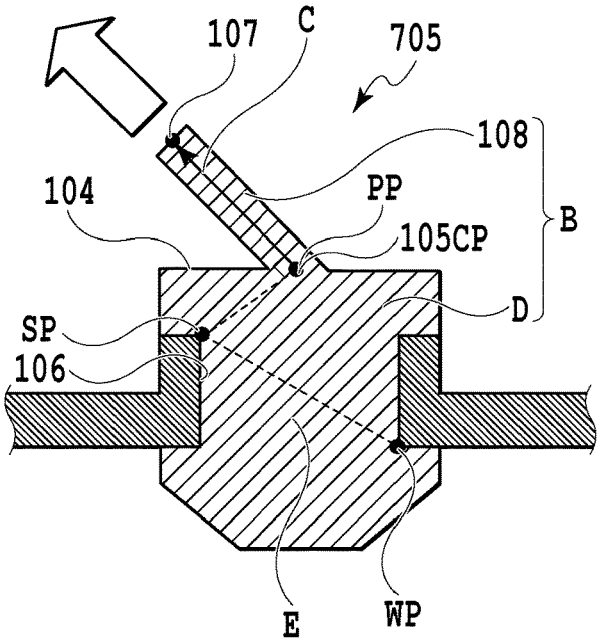
FIG. 9A shows the plug member.
Figure 9B:
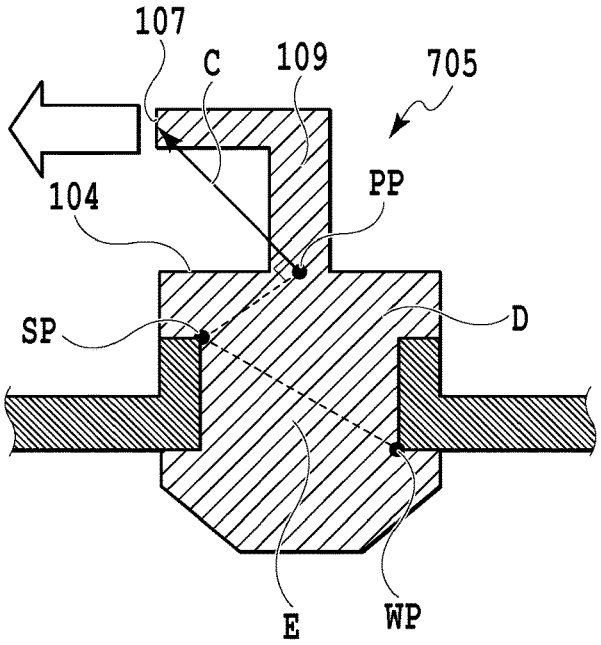
FIG. 9B shows the plug member.

FIG. 8 shows a conventional plug member 605, and FIGS. 9A and 9B show the plug member of the present embodiment. FIGS. 9A and 9B show cross-sectional views of the plug member of this embodiment corresponding to FIG. 5A. In the embodiment described above, the support member is provided on the plug member, but in the present embodiment, the support member may not be provided. The plug member is equipped with a main body part B lying on the outside relative to the storing chamber 100 and the supply port 106 in a state mounted on the supply port 106, and a plug part E to be inserted in the supply port 106 to plug up the supply port 106. The plug member is transformed elastically to be mounted in a manner sandwiching the supply port 106 from above and below. Further, the main body part B of the plug member is equipped with a cover part D covering the opening surface of the supply port 106, and a protruding part protruding from the cover part (606 in FIG. 8, 108 in FIG. 9A). The protruding part also works as a pinch part that is pinched by a user when the user removes the plug member for supplying a liquid.

The user pulls the pinch part and removes the plug member so as to pull out the member. In the present specification, a protruding part is also called a pinch part. As shown in FIG. 9A, a pinch part 108 protrudes from the upper surface 104 of the cover part D along the opening surface of the supply port 106 in a state that the plug member is mounted on the supply port. Note that, "protruding" of the protruding part 108 in the present specification refers to such a state that the protruding part 108 protrudes sufficiently to such a degree that the user can pinch the part or add force to the part.

However, when the plug member is pulled in the direction where the pinch part 606 extends as is the case for the conventional plug member 605 in which a pinch part 506 is perpendicular to the supply port opening surface, it can be pulled out only when the whole plug member is deformed in parts in which the plug member 605 and the inner wall surface of the supply port 106 are press-fitted. Consequently, large force is required when removing the plug member 605. Therefore, a plug member 705 in the present embodiment is equipped with the configuration as shown in FIGS. 9A and 9B.

In the plug member 705 in the present embodiment, the base of the pinch part 108 which is the connection part with the upper surface 104 of the cover part D is provided in a position including the center 105CP (the centroid) of the upper surface 104, and the pinch part 108 is provided at an angle inclined from the vertical direction relative to the supply port opening surface. That is, the pinch part 108 of the plug member 705 is provided so that a (hypothetical) shortest line (an arrow C shown in FIG. 9A) connecting the base part of the pinch part 108 with an apical part 107 thereof inclines relative to the opening surface of the supply port 106 when the plug member 705 is mounted on the supply port 106. Note that the apical part described here refers to an apical part that is pinched by a user in the pinch part 108, instead of a bent intermediate point in a case where a pinch part is bent at the intermediate point. Further, the apical part 107 is also a part lying in a position most apart from the base part of the pinch part 108.

As the result of providing the pinch part 108 in an inclined manner as described above, the user, when removing the plug member 705 from the supply port 106, is facilitated to pull the pinch part 108 in the inclined direction (extending direction). By pulling the pinch part 108 in the inclined direction in this way, the plug member 705 is deformed gradually from the opposite side of the inclined side of the pinch part 108 to be taken out from the supply port 106, and the removal with comparatively weak force becomes possible. Further, the plug member 705 is deformed from one side to release gradually the force in the press-fitted part and is removed, and, therefore, the plug member 705 is not removed instantaneously from the supply port 106 in the removal, and scattering of the liquid in the liquid storage container 16 to the outside can be suppressed.

Note that the angle of the pinch part 108 is desirably set as an angle intersecting perpendicularly relative to a line connecting the base PP of the pinch part (power point) with an inner hull SP (supporting point) of the supply port, as shown in FIG. 9A. Consequently, when the pinch part 108 is pulled in the inclined direction, according to the principle of leverage, force applied to the working point WP becomes largest to make the plug member 705 be deformed most easily.

Modified Example

FIG. 9B shows a plug member in a modified example of the present embodiment. When a pinch part is provided in an inclined manner, a space for putting in a finger for performing the pinch becomes small depending on magnitude of the plug member 705. Accordingly, as in FIG. 9B, a pinch part 109 of the plug member has a shape that extends in the direction perpendicular to the injection port opening surface in the base part but has an angle from the middle thereof. As the result of having such a shape, a sufficient space for inserting a finger for pinching can be secured so as to facilitate removal of the plug member 705, even when the plug member 705 is comparatively small.

Note that, in the present embodiment, such a configuration is described that the plug member 705 is equipped with the main body part B and the plug part E, but the configuration is not limited thereto. A so-called cap type member, which is configured only from the main body part B, that is, only from the cover part D and the pinch part without including the plug part E, is also acceptable.

As described above, the pinch part of the plug member is provided so that the shortest line connecting the base part being a proximal end of the pinch part with the apical part being a distal end of the pinch part inclines relative to the opening surface of the supply port when the plug member is mounted on the supply port. That is, the pinch part of the plug member is provided so that the shortest line connecting the base part of the pinch part with the apical part thereof (the arrow C) inclines relative to the opening surface of the supply port. Hereby, there is be realized a liquid storage container equipped with a plug member capable of preventing leakage of a liquid from the liquid storage container and being opened without causing scatter of the liquid, and a liquid ejection apparatus equipped with the liquid storage container.

Fourth Embodiment

Hereinafter, a fourth embodiment of the present invention will be described with reference to the drawings. Note that the basic configuration of the present embodiment is the same as that of the first embodiment, and, therefore, only characteristic configurations will be described.

Figure 10C:
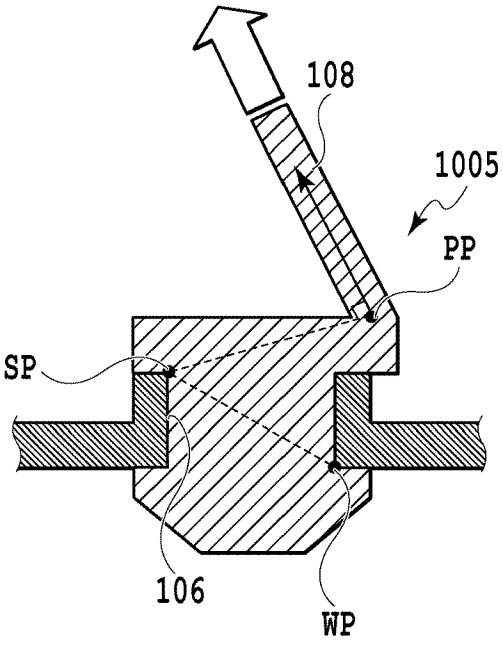
FIG. 10C shows the plug member.
Figure 10B:
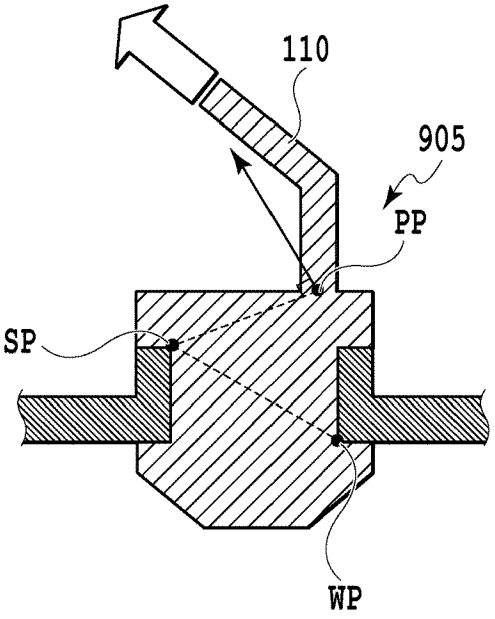
FIG. 10B shows the plug member.
Figure 10A:
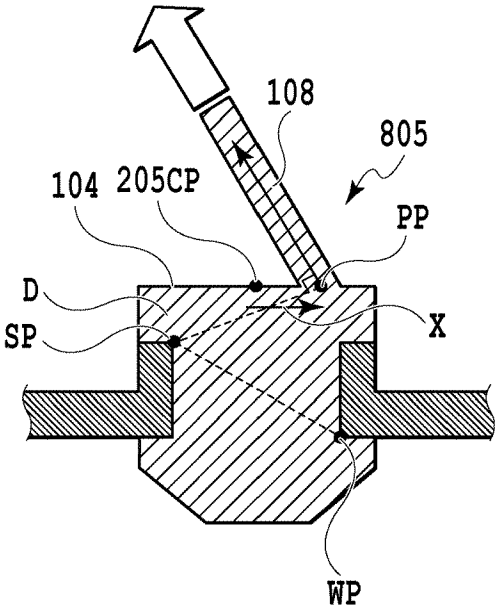
FIG. 10A shows the plug member.

FIG. 10A shows a plug member 805 in the present embodiment. In the plug member 805 in the present embodiment, the base position of the inclined pinch part 108 is provided in a position offset from the center (the centroid) 205CP of the upper surface 104 of the cover part D configuring the plug member 805. Specifically, the base part of the pinch part 108 is provided in a position offset along the upper surface 104 and in the opposite direction to the direction toward the apical part from the base part of the pinch part 108 (the arrow X direction shown in 10A), relative to the center 205CP of the upper surface 104. It is considered that, usually, a user pulls the pinch part 108 in the extending direction of the pinch part 108 to take out the plug member 805.

Accordingly, since the base part of the pinch part 108 is provided offset in the arrow X direction from the center 205CP of the plug member 805, the distance between the power point PP and the supporting point SP can be elongated to utilize effectively the principle of leverage. Note that, providing the base part of the pinch part 108 offset in the opposite direction to the arrow X direction relative to the center 205CP of the plug member 805, causes the distance between the power point PP and the supporting point SP to become short, reducing the effect of the easy removal of the plug member 805. Accordingly, the base part of the pinch part 108 is preferably provided offset in the above-described direction.

Note that, in the present embodiment, the shape of the upper surface 104 of the cover part D is circular, and the center of the upper surface 104 and the centroid of the upper surface 104 lie at the same position. Therefore, "the center (centroid)" may be used instead of "the centroid (center)" in the description. Further, the shape of the upper surface of the cover part D is not limited to circular, and, for example, may be a symmetric shape such as a rectangle, or an asymmetric shape. In these cases, too, it is sufficient to provide the base part of the pinch part 108, offset in the opposite direction to the direction toward the apical part from the base part of the pinch part 108, relative to the centroid of the upper surface 104 of the plug member 805, that is, the center of mass when mass is distributed uniformly in the upper surface 104 of the cover part D.

Modified Examples

FIG. 10B shows a plug member 905 in a modified example of the present embodiment. When a pinch part is provided in an inclined manner, a space for putting in a finger for performing the pinch becomes small depending on magnitude of the plug member. Accordingly, as in FIG. 10B, a pinch part 110 of the plug member 905 has such a shape such that the pinch part, extending in the direction perpendicular to the supply port opening surface at the base part, takes an angled shape midway thereof.

FIG. 10C shows a plug member 1005 in a modified example of the present embodiment. When an arrangement is possible on a structure of the liquid ejection apparatus 200, it is possible to elongate more the distance between the power point PP and the supporting point SP when at least a part of the base part of the pinch part 108 is provided so as to lie on the outside of the periphery of the supply port 106. Hereby, the principle of leverage can be utilized more effectively to facilitate removal of the plug member 1005.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-086464, filed Apr. 22, 2016, and No. 2016-086461, filed Apr. 22, 2016, which are hereby incorporated by reference wherein in their entirety.

What is claimed is:

1. A liquid storage container, comprising a storage chamber for storing a liquid, a supply port constructed to supply a liquid to the storage chamber, and a cover member mounted detachably on the supply port, wherein the cover member includes a main body part lying outside of the storage chamber and the supply port in a state mounted on the supply port;

the main body part includes a cover part covering an opening surface of the supply port in the mounted state of the cover member, a support part constructed to connect the cover part with another member with the cover member removed from the supply port, and a convex part protruding from the cover part; and the convex part is arranged only on one side of the cover part and the support part is arranged on the other side of the cover part relative to a straight line intersecting orthogonally with a straight line passing a centroid of the cover part and connecting the centroid and the support part, seen from a direction intersecting orthogonally with the opening surface in the mounted state of the cover member.

2. The liquid storage container according to claim 1, wherein the convex part protrudes upward from an upper face of the cover part along the opening surface, in the mounted state of the cover member.

3. The liquid storage container according to claim 1, wherein the convex part protrudes toward the outside of the cover part from a side face intersecting approximately orthogonally with the opening surface of the cover part, in the mounted state of the cover member.

4. The liquid storage container according to claim 3, wherein the main body part includes a plurality of the convex parts.

5. The liquid storage container according to claim 3, wherein a groove is formed on the side face of the cover part.

6. The liquid storage container according to claim 1, wherein the support part is formed integrally with the cover part.

7. The liquid storage container according to claim 1, wherein the support part is formed as a separate body from the cover part.

8. The liquid storage container according to claim 1, wherein the cover member includes a plug part inserted in the supply port to plug up the supply port, a protruding part is provided for the plug part, and the protruding part plugs up the supply port.

9. The liquid storage container according to claim 1, wherein a part of the convex part is arranged on an extension line of the straight line connecting the centroid and the support part, seen from the direction intersecting orthogonally with the opening surface in the mounted state of the cover member.

10. The liquid storage container according to claim 1, wherein the convex part is arranged at an end part of the cover part on the one side, and the support part is arranged at an end part of the cover part on the other side, seen from the direction intersecting orthogonally with the opening surface in the mounted state of the cover member.

11. The liquid storage container according to claim 1, wherein the convex part is a pinch part to be used when removing the cover member.

12. The liquid storage container according to claim 1, wherein the convex part is not arranged on the centroid of the cover part.

13. The liquid storage container according to claim 1, wherein the cover member is a cap type member that does not have a plug part.

14. A liquid ejection apparatus, comprising:

a liquid ejection head that ejects liquid;

a liquid storage container constructed to store a liquid supplied to the liquid ejection head, including a storage chamber for storing a liquid and a supply port constructed to supply a liquid to the storage chamber from an outside; and a cover member that mounts detachably on the supply port, wherein the cover member includes a main body part lying outside of the storage chamber and the supply port in a state mounted on the supply port;

the main body part includes a cover part covering an opening surface of the supply port in the mounted state of the cover member, a support part constructed to connect the cover part with another member with the cover member removed from the supply port, and a convex part protruding from the cover part; and the convex part is arranged only on one side of the cover part and the support part is arranged on the other side of the cover part relative to a straight line intersecting orthogonally with a straight line passing a centroid of the cover part and connecting the centroid and the support part, seen from a direction intersecting orthogonally with the opening surface in the mounted state of the cover member.

15. The liquid ejection apparatus according to claim 14, wherein the convex part protrudes toward the outside of the cover part from a side face intersecting approximately orthogonally with the opening surface of the cover part, in the mounted state of the cover member.

16. The liquid ejection apparatus according to claim 14, wherein the support part is formed as a separate body from the cover part.

17. The liquid ejection apparatus according to claim 14, wherein a part of the convex part is arranged on an extension line of the straight line connecting the centroid and the support part, seen from the direction intersecting orthogonally with the opening surface in the mounted state of the cover member.

18. The liquid ejection apparatus according to claim 14, wherein the convex part is a pinch part to be used when removing the cover member.

19. The liquid ejection apparatus according to claim 14, wherein the convex part is not arranged on the centroid of the cover part.

20. The liquid ejection apparatus according to claim 14, wherein the cover member is a cap type member that does not have a plug part.

21. A liquid ejection apparatus, comprising:

a liquid ejection head that ejects liquid;

a storage chamber for storing a liquid supplied to the liquid ejection head;

a supply port constructed to supply a liquid to the storage chamber; and a cover member mounted detachably on the supply port, wherein the cover member includes a main body part lying outside of the storage chamber and the supply port in a state mounted on the supply port;

the main body part includes a cover part covering an opening surface of the supply port in the mounted state of the cover member, and a convex part protruding from the cover part; and an apical part of the convex part most apart from a connection part of the convex part connected with the cover part extends along a direction inclined relative to the opening surface in the mounted state of the cover member.

22. The liquid ejection apparatus according to claim 21, wherein the convex part protrudes upward from an upper face of the cover part along the opening surface in the mounted state of the cover member.

23. The liquid ejection apparatus according to claim 22, wherein the connection part is provided in a position including the centroid of the upper face of the cover part.

24. The liquid ejection apparatus according to claim 22, wherein the connection part is provided offset in an opposite direction to a direction running along the upper face from the connection part toward the apical part, relative to the centroid of the upper face of the cover part.

25. The liquid ejection apparatus according to claim 21, wherein at least a part of the connection part is provided in a position lying outside of a periphery of the supply port in the mounted state of the cover member.

26. The liquid ejection apparatus according to claim 21, wherein the convex part is bent between the connection part and the apical part.

27. The liquid ejection apparatus according to claim 21, wherein the cover member includes a plug part that is inserted in the supply port to plug up the supply port.

28. The liquid ejection apparatus according to claim 21, wherein the convex part is a pinch part to be used when removing the cover member.

29. The liquid ejection apparatus according to claim 21, wherein the cover member is a cap type member that does not have a plug part.

* * * * *